US008269189B2

(12) United States Patent
Ma et al.

(10) Patent No.: US 8,269,189 B2
(45) Date of Patent: Sep. 18, 2012

(54) METHODS AND SYSTEMS FOR INCREASING THE ENERGY OF POSITIVE IONS ACCELERATED BY HIGH-POWER LASERS

(75) Inventors: Chang-ming Ma, Huntingdon Valley, PA (US); Iavor Veltchev, Huntingdon Valley, PA (US); Eugene S. Fourkal, Huntingdon Valley, PA (US)

(73) Assignee: Fox Chase Cancer Center, Philadelphia, PA (US)

( * ) Notice: Subject to any disclaimer, the term of this patent is extended or adjusted under 35 U.S.C. 154(b) by 142 days.

(21) Appl. No.: 12/742,769

(22) PCT Filed: Nov. 13, 2008

(86) PCT No.: PCT/US2008/083294

§ 371 (c)(1),
(2), (4) Date: Jul. 22, 2010

(87) PCT Pub. No.: WO2009/108225

PCT Pub. Date: Sep. 3, 2009

(65) Prior Publication Data

US 2010/0320394 A1 Dec. 23, 2010

Related U.S. Application Data

(60) Provisional application No. 60/988,134, filed on Nov. 15, 2007.

(51) Int. Cl.
*H01J 49/06* (2006.01)

(52) U.S. Cl. ..... 250/423 R; 250/492.3; 250/398

(58) Field of Classification Search ..... 250/423 R
See application file for complete search history.

(56) References Cited

U.S. PATENT DOCUMENTS

| | | | | |
|---|---|---|---|---|
| 5,235,606 | A | 8/1993 | Mourou et al. | |
| 6,680,480 | B2 * | 1/2004 | Schoen | 250/423 R |
| 6,852,985 | B2 * | 2/2005 | Cowan et al. | 250/423 P |
| 7,710,007 | B2 * | 5/2010 | Liang | 313/231.31 |
| 2002/0090194 | A1 | 7/2002 | Tajima | |
| 2005/0279947 | A1 * | 12/2005 | Feurer et al. | 250/398 |

(Continued)

FOREIGN PATENT DOCUMENTS

WO WO 2004/109717 A2 12/2004

(Continued)

OTHER PUBLICATIONS

Borghesi et al., "Ultrafast charge dynamics initiated by high-intensity, ultrashort laser-matter interaction", AIP conference proceedings AIP USA, Apr. 7, 2006, 827(1), 191-202.

(Continued)

*Primary Examiner* — Phillip A Johnston
(74) *Attorney, Agent, or Firm* — Woodcock Washburn, LLP

(57) ABSTRACT

The energy of positive ions accelerated in laser-matter interaction experiments can be significantly increased by providing a plurality of laser pulses, e.g., through the process of splitting the incoming laser pulse, to form multiple laser-matter interaction stages. From a thermodynamic point of view, the splitting procedure can be viewed as an effective way of increasing the efficiency of energy transfer from the laser light to positive ions, which energy peaks for processes having the least amount of entropy gain. A 100% increase in the energy efficiency is achieved for a six-stage laser positive ion accelerator compared to a single-stage laser positive ion accelerator.

70 Claims, 7 Drawing Sheets

U.S. PATENT DOCUMENTS

2009/0230318 A1 9/2009 Fourkal et al.

FOREIGN PATENT DOCUMENTS

WO WO 2006/086084 A2 8/2006
WO WO 2009/108225 A2 9/2009

OTHER PUBLICATIONS

Fourkal et al., "Particle selection for laser-accelerated proton therapy feasibility study", Med. Phys., Jul. 2003, 30(7), 1660-1670.
Fuchs et al., "Laser-foil acceleration of high-energy protons in small-scale plasma gradients", physical review letters APS USA, Jul. 6, 2007, 99(1), 07-06.
Ma et al., "Laser-Accelerated proton beams for radiation therapy", 2001 AAPM Annual Meeting Program, Med. Phys., Jun. 2001, MO-E-150A-03, 23(6) 1236.
Mima et al., "Osakapic Simulation and experimental researches on laser particle acceleration and their applications", the 11th advanced accelerator concepts workshop Stoney Brook, NY, Jun. 21-26, 2004, 1-31.
Mima, "PIC simulation and experimental researches on high energy ion generation", the 11th advanced accelerator concepts workshop Stony Brook, NY, Jun. 21-26, 2004, 1-6.

* cited by examiner

Stage I
Stage II
Stage III
delay
100
102
104
106
108
112
114
116
118
120
122
124
126
128
132
134
136
138
142
144
146
148
22
24
26
28

M – mirror
OPM – off-axes parabolic mirror
BS – beam splitter 50% transmission

Two Stage Accelerator

Three Stage Accelerator

METHODS AND SYSTEMS FOR INCREASING THE ENERGY OF POSITIVE IONS ACCELERATED BY HIGH-POWER LASERS

CROSS-REFERENCE TO RELATED APPLICATIONS

This application is the National Stage of International Application No. PCT/US2008/083294 filed Nov. 13, 2008, which claims the benefit of U.S. Application No. 60/988,134, filed Nov. 15, 2007, the disclosures of which are incorporated herein by reference in their entirety.

FIELD OF THE INVENTION

The present invention is in the field of accelerating positive ions, such as protons, to high energy levels using high-power lasers. The present invention is also in the field of hadron therapy using positive ions accelerated by high-power lasers.

BACKGROUND OF THE INVENTION

Ion acceleration by high-power lasers has attracted significant attention in recent years from the scientific community due to its potential applications in different branches of physics and technology. The physical characteristics of accelerated protons, such as high collimation and high particle flux, make them very attractive for applications in controlled nuclear fusion, material science, and hadron therapy.

The physical processes responsible for ion acceleration during laser-matter interaction are understood on a qualitative level. For high laser intensities ($I \leqq 10^{21}$ W/cm$^2$), the target normal sheath acceleration (TNSA) mechanism has become a well accepted explanation for rear target proton acceleration. It is believed that the incoming laser pulse quickly ionizes the target pushing some of the electrons out of it through the action of the ponderomotive force. A strong electrostatic field (on the order of teravolts per meter, "~TV/m") is set up between the expanding electrons and the target, which field ionizes a thin hydrogen-rich layer present at the target's back surface. Subsequently, the protons are accelerated in this electrostatic field. For thicker targets ($\geqq 2$ μm) a shock wave acceleration mechanism has also been proposed in which a laser acts as a piston driving a flow of ions into the target and launching an electrostatic shock at the front of the target with high Mach number $M=v_{shock}/c$ is about equal 0.2-0.3. Protons, reflected off the shock front may get accelerated to velocities up to $v_{ions}=2v_{shock}$.

Multi-parametric particle-in-cell (PIC) simulation studies of the interaction between a clean (no prepulse present) high-power laser pulse and thin double-layer target have been made. These studies mapped maximum proton energy regions as functions of target electron density and its thickness as well as laser pulse length for different laser intensities and spot sizes. Protons can be accelerated using laser light to the energy range of about a few hundred MeV (e.g. as required for hadron therapy applications where protons with energy 250 MeV can reach any disease site throughout a patient's body). Such acceleration requires a few hundred joules of energy or equivalently several tens of petawatt of power for laser pulse duration $L_p$~100 fs. This energy is pumped into a laser pulse, the characteristics of which are provided for a particular target. Currently available lasers, specifically compact table-top systems, operate in the sub-picosecond regime and provide energy on the order of $E_l$~10 J. According to the scaling laws, current table-top lasers may be insufficient to accelerate protons to the energy range of about 200 to 250 MeV. Therefore, there is a need to increase the maximum proton energy, or equivalently the efficiency of energy transfer from the laser pulse into accelerated protons, without necessarily requiring an increase in laser pulse energy.

SUMMARY OF THE INVENTION

We believe that we have now recognized a problem that has been limiting the ability to accelerate protons using a laser pulse. Without being bound by any theory of operation, we now believe that the acceleration conditions for protons in a double layer target system are not optimal due to the fact that protons are expelled from the back surface of the substrate before the maximum electric field is established. As a result, the protons experience a reduced acceleration potential that gives rise to reduced proton energies. Accordingly, we have solved this problem with several different methods and systems that incorporate a combination of two or more laser pulses interacting with two or more targets. As further described herein, the new methods and systems increases the acceleration of positive ions, such as protons, by increasing the interaction between the ions and the electric field generated at the target. As a result, the disclosed methods and systems increase positive ion acceleration, and hence increases the resulting energy of the positive ions. According to one aspect of the present invention, higher final positive ion energies can be achieved by modifying the dynamics, for example, by splitting the pulse into two or more interaction stages. In one example wherein the positive ions are protons, up to about 30% or higher increase in the final proton energy, as compared to a single interaction stage, can be achieved through a double splitting procedure. The energy transfer efficiency from the laser pulse to protons can be further improved by using even more, i.e., n, interaction stages to increase the final proton energy.

Splitting a single interaction scheme into n stages gradually increases the energy transferred from the laser pulse to a proton beam with each additional splitting, thus increasing the final energy of the proton beam. Without being bound by any particular theory of operation, a thermodynamic (i.e., heat transfer) approach is used to explain this effect. For example, an efficient way of transferring the energy from a hot object (laser) to a cold object (protons) is to analyze that the initially hot object becomes cold, and the initially cold object becomes hot. Using this example, efficient heat exchange occurs when the cold and hot objects are split into n equal pieces and each individual hot piece is put into thermal contact with each individual cold piece (without mixing them) in a sequential manner. In the end, initially hot/cold pieces are put back together to form a new cold/hot object correspondingly. As the number of splits increases, the entropy change $\Delta S$ for the whole process decreases and in the limit $n \rightarrow \infty$, $\Delta S \rightarrow 0$. In this case the initially cold object becomes hot (with temperature equal to the initial temperature of the hot object) and initially hot object becomes cold (with temperature equal to the initial temperature of the cold object) and the perfect (completely reversible) heat exchange process is achieved. Similar physics is at play when the laser pulse is split into n sub-pulses of equal intensity $I_0/n$ that are made to interact with n targets. In this case, the energy transfer efficiency (kinetic energy of the accelerated protons) increases for those processes in which the entropy gain decreases. Just as in the case with hot/cold reservoirs, the splitting procedure is an effective way of reducing the total entropy gain, thus increasing the energy transferred from the laser pulse to protons. This process is referred to as "adiabatic acceleration".

Accordingly, one aspect of the invention provides methods of generating positive ions, comprising: directing at least one laser pulse to a first target to give rise to positive ions emanating from the first target, the positive ions being directed towards a second target; directing at least one other laser pulse to a second target to give rise to an electric field capable of further accelerating the positive ions arriving at the second target; and accelerating the positive ions using the electric field arising from the interaction of the at least one other laser pulse with the second target.

Another aspect of the present invention provides methods of accelerating positive ions, comprising: providing n laser pulses, wherein n is an integer greater than 1; directing a first n=1 laser pulse to a first n=1 target at a time $t_1$ to give rise to positive ions emanating from the first n=1 target, the positive ions being directed towards a series of additional n−1 targets, the positive ions emanating from the first n=1 target arriving first at the n=2 target at a time $t_2$ later than $t_1$; directing each of the other n−1 laser pulses individually to each of the n−1 targets at a time $t_{n-1}$ to give rise to an electric field in each of the n−1 targets; and accelerating the positive ions serially from target to target using the electric field arising from the interaction of each of the n−1 laser pulses with each of the n−1 targets.

Further aspects of the present invention provide systems for generating positive ions, comprising: at least one laser pulse source; a series of n−1 beam splitters capable of splitting a laser pulse emanating from the laser pulse source into n laser pulses, wherein n is greater than 1; a series of n targets each being oriented in an individual optical path that is capable of interacting individually with each one of the individual laser pulses, the first n=1 target capable of giving rise to positive ions upon interaction with the n=1 laser pulse, wherein the remaining n−1 targets are positionally situated to be capable of receiving the positive ions in series from a previous target, wherein each of the targets are capable of interacting with a laser pulse to give rise to an electric field capable of accelerating the positive ions; and a series of n−1 optical delays situated to give rise to a delay in each of the n−1 laser pulses arriving at each of the n−1 targets.

In related aspects, there are provided systems for accelerating positive ions, comprising: a series of n−1 beam splitters capable of splitting a laser pulse emanating from a laser pulse source into n laser pulses, wherein n is greater than 1; a series of n targets each being oriented in an individual optical path that is capable of interacting individually with each one of the individual laser pulses, the first n=1 target capable of giving rise to positive ions upon interaction with the n=1 laser pulse, wherein the remaining n−1 targets are positionally situated to be capable of receiving the positive ions in series from a previous target, wherein each of the targets are capable of interacting with a laser pulse to give rise to an electric field capable of accelerating the positive ions; and a series of n−1 optical delays situated to give rise to a delay in each of the n−1 laser pulses arriving at each of the n−1 targets.

In other aspects, the present invention provides systems for generating positive ions, comprising: at least one laser pulse source; a series of n−1 beam splitters capable of splitting a laser pulse emanating from the laser pulse source into n laser pulses, wherein n is greater than 1; a series of n targets capable of interacting with a laser pulse and generating an electric field in each of the n−1 targets; an optical path capable of directing a first n=1 laser pulse to a first n=1 target at a time $t_1$ to give rise to positive ions emanating from the first n=1 target, the positive ions capable of being directed towards the additional n−1 targets, the positive ions capable of emanating from the first n=1 target arriving at the n=2 target at a time $t_2$ later than $t_1$.

Other aspects of the present invention provide systems for generating positive ions, comprising: n laser pulse sources capable of generating n laser pulses, wherein n is greater than 1; a series of n targets each being oriented in an individual optical path that is capable of interacting individually with each one of the individual n laser pulses, the first n=1 target capable of giving rise to positive ions upon interaction with the n=1 laser pulse, wherein the remaining n−1 targets are positionally situated to be capable of receiving the positive ions in series from a previous target, wherein each of the targets are capable of interacting with a laser pulse to give rise to an electric field capable of accelerating the positive ions.

The general description and the following detailed description are exemplary and explanatory only and are not restrictive of the invention, as defined in the appended claims. Other aspects of the present invention will be apparent to those skilled in the art in view of the detailed description of the invention as provided herein.

BRIEF DESCRIPTION OF THE DRAWINGS

The summary, as well as the following detailed description, is further understood when read in conjunction with the appended drawings. For the purpose of illustrating the invention, there are shown in the drawings exemplary embodiments of the invention; however, the invention is not limited to the specific methods, compositions, and devices disclosed. In addition, the drawings are not necessarily drawn to scale. In the drawings.

DETAILED DESCRIPTION OF ILLUSTRATIVE EMBODIMENTS

Figures 1A, 1B, 1C:
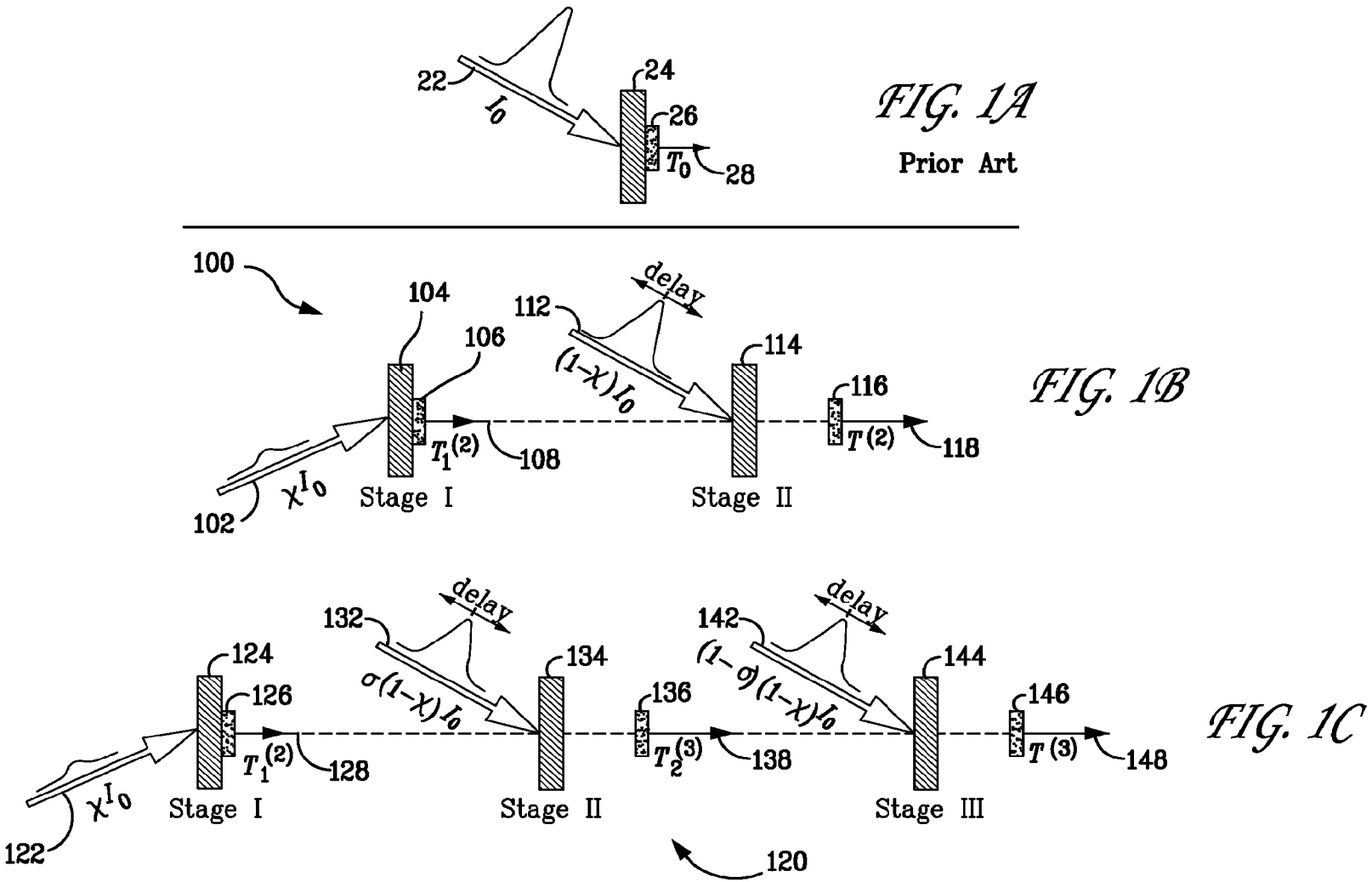
FIG. 1A Prior Art
FIG. 1 illustrates a) a conventional double-layer target geometry (prior art); b) a two-stage positive ion generation system and process according to an embodiment of the present invention; and c) a three-stage positive ion generation system and process according to an embodiment of the present invention.

The present invention may be understood more readily by reference to the following detailed description taken in connection with the accompanying figures and examples, which form a part of this disclosure. It is to be understood that this invention is not limited to the specific devices, methods, applications, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

It is to be appreciated that certain features of the invention which are, for clarity, described herein in the context of separate embodiments, may also be provided in combination in a single embodiment. Conversely, various features of the invention that are, for brevity, described in the context of a single embodiment, may also be provided separately or in any subcombination. Further, reference to values stated in ranges include each and every value within that range.

The inventions provided herein can be used with the compact, flexible and cost-effective laser-accelerated proton therapy systems as described in Fourkal, E., et al., "Particle selection for laser-accelerated proton therapy feasibility study", *Med. Phys.,* 2003, 1660-70; Ma, C.-M, et al. "Laser Accelerated proton beams for radiation therapy", *Med. Phys.,* 2001, 1236. These systems are based upon several technological developments: (1) laser-acceleration of high-energy protons, and (2) compact system design for particle (and energy) selection and beam collimation. Related systems, devices, and methods are disclosed in International Patent Application No. PCT/US2004/017081, "High Energy Polyenergetic Ion Selection Systems, Ion Beam Therapy Systems, and Ion Beam Treatment Centers", filed on Jun. 2, 2004, the entirety of which is incorporated by reference herein. For example, FIG. 17 of the PCT/US2004/017081 application depicts a laser-accelerated polyenergetic positive ion beam therapy system, further details of which can be found in that application. Likewise, FIG. 41 of the PCT/US2004/017081 application depicts a sectional view of a laser-accelerated high energy polyenergetic positive ion therapy system, further details of which can be found in that application. Such systems provide a way for generating small beamlets of polyenergetic protons, which can be used for irradiating a targeted region (e.g., tumors, lesions and other diseased sites) to treat patients.

A variety of commercially available high-powered laser systems and targets can be used in the present invention to generate and accelerate positive ions. Suitable laser systems are described in U.S. Pat. No. 5,235,606, issued Aug. 10, 1993 to Mourou et al., the entirety of which is incorporated by reference herein. U.S. patent application Ser. No. 09/757,150, filed by Tajima on Jan. 8, 2001, Pub. No. U.S. 2002/0090194 A1, Pub. Date Jul. 11, 2002, "Laser Driven Ion Accelerator" discloses a system and method of accelerating ions in an accelerator using a high intensity laser, the details of which are incorporated by reference herein in their entirety. Additional target designs are provided in "Target Design for High-Power Laser Accelerated Ions", International PCT App. Pub. No. WO/2006/086084, published 17 Aug. 2006, which is also U.S. patent application Ser. No. 11/720,886, "Target Design for High-Powered Laser Accelerated Ions" by E. Fourkal, et al., the entirety of which is incorporated by reference herein in its entirety. Positive ions such as protons that are accelerated with high-power lasers are typically characterized as having an energy distribution peak in the range of from about 1 MeV to about 100 MeV. Laser-accelerated positive ions are typically characterized as having a distribution of energy levels, which energy distribution is further characterized as having a maximum in intensity at its peak.

Suitable positive ions that can be accelerated using the methods and systems described herein include hydrogen, boron, carbon, nitrogen, oxygen, an isotope of hydrogen, an isotope of boron, an isotope of carbon, an isotope of nitrogen, an isotope of oxygen, or any combination thereof. Typically the positive ions are incorporated as their corresponding atoms in, on, or proximate to a target. The first target may contain a layer of material comprising the corresponding atoms, or molecules that contain the corresponding atoms that will form the laser accelerated positive ions. For example, a layer of water (i.e., $H_2O$) or a hydrogen-containing film (e.g., a hydrocarbon polymer such as polyethylene) can be disposed adjacent to a metal target. A suitable first target comprises a metal layer and at least one positive ion source layer comprising hydrogen, boron, carbon, nitrogen, oxygen, an isotope of hydrogen, an isotope of boron, an isotope of carbon, an isotope of nitrogen, an isotope of oxygen, or any combination thereof. The target can be oriented with the metal layer towards the at least one laser pulse. Any of a variety of metals can be used in the targets. Suitable target metals include copper gold and silver. Suitable target materials are also described in U.S. patent application Ser. No. 11/720,886, "Target Design for High-Powered Laser Accelerated Ions" by E. Fourkal, et al., the entirety of which is incorporated by reference herein in its entirety. Suitable first targets comprise at least one positive ion source layer comprising a hydrogen-rich layer, a deuterium-rich layer, a boron-rich layer, a carbon-rich layer, a nitrogen-rich layer, an oxygen-rich layer, or any combination or isotope thereof. The positive ion source player is suitably disposed adjacent to a metal target layer. The positive ion source layer is typically oriented away from the laser pulse. A suitable isotope of hydrogen includes deuterium, which can be supplied to the target as a layer of heavy water (liquid or solid $D_2O$), as a layer of liquid $D_2$, or as a deuterated polymeric coating, such as a deuterated polyolefin. Isotopes of other elements, especially the stable isotopes, can also be fashioned into one or more coatings and can be applied to metal targets.

Methods of generating positive ions include using a series of two or more high-powered laser pulses to generate and accelerate positive ions to energies greater than about 10 MeV. In an initial step, at least one laser pulse is directed to a first target to give rise to positive ions emanating from the first target, and the positive ions being directed towards a second target. A moment afterwards, at least one other laser pulse is directed to a second target to give rise to an electric field capable of further accelerating the positive ions arriving at the second target. Accordingly, the arrival of the positive ions at the second target and the at least one other laser pulse (second laser pulse), are typically timed to occur simultaneously, so that the positive ions are further accelerated using the electric field arising from the interaction of the second laser pulse with the second target. This process can be continued in series with additional third, fourth, fifth, etc. laser pulses and targets to increase the energy of the positive ions even further. Additional configurations of laser pulses and targets were also conceivable, for example, several laser pulses in parallel can be directed to one or more targets to give rise to increased intensity of the positive ions. The energy of positive ions, such as protons, can be increased using these methods from about 10 MeV a up to about 50 MeV, or even up to about 60 MeV, or even up to about 70 MeV, or even up to about 80 MeV, or even up to about 90 MeV, or even up to about 100 MeV, or even up to about 120 MeV, or even up to about 140 MeV, or even up to about 160 MeV, or even up to about 180 MeV, or even up to about 200 MeV, or even up to about 220 MeV, or even up to about 250 MeV.

Positive ions emanating from the second target will have higher energies relative to that of the first target. Accordingly, positive ions emanating from a subsequent target will have higher energies relative to that of its previous target. Depending on the arrangement of the lasers and the targets, the increase in peak energy of the positive ions gained from a subsequent laser pulse acceleration can vary anywhere between about 1% and 100% at the peak energy of the positive ions prior to the subsequent laser pulse. Lower percentages can be up achieved when a laser pulse is split using a suitable splitting mechanism such as a beam splitter. Higher percentages can be achieved when a laser pulse is provided using a separate laser source. Accordingly, the energy distribution peak of the positive ions after interacting with a second laser pulse can be in the range of from greater than about 10 MeV up to about 200 MeV. Accordingly, the laser pulses can be provided by using a plurality of lasers, splitting a laser pulse into two or more subpulses, or any combination thereof. In some embodiments, the positive ions accelerated by the second target are characterized as having an energy distribution peak that is at least about 20% higher, or at least about 30% higher, or at least about 40% higher, or at least about 50% higher, or at least about 60% higher as the energy distribution peak of the positive ions emanating from (i.e., generated in) the first target. In other embodiments at least three laser pulses and three targets can be used in series to generate the positive ions. The positive ions emanating from the third target are characterized as having an energy distribution peak that is at least about 20% higher, or at least about 30% higher, or at least about 40% higher, or at least about 50% higher, or at least about 60% higher than the energy distribution peak of the positive ions emanating from the first target.

During operation, at least one laser pulse other than the first laser pulse, such as a second laser pulse, is delayed so as to arrive at a later target (e.g., the second target) at a time later than the arrival of the laser pulse at the first target. The time delay is selected so that the second laser pulse interacts with the arrival of the positive ions arriving from the first target. Additional laser pulses, if desired, are also timed so that each of their pulses interact with the arrival of the positive ions arriving from the previous target. At least one of the laser pulses can be delayed using a series of mirrors to give rise to an optical path delay. The optical path delay can operate so that the optical path of at least one other laser pulse arriving at a second target is longer than the optical path of the at least one laser pulse arriving at the first target. Any number and combination of laser pulses and optical paths are envisioned for generating positive ions. For example, the number of laser pulses to generate the positive ions can be 2, or 3, or 4, or 5, or 6, or 7, or 8, or 9, or 10, or about 15, or about 20, or about 30, or about 40, or even about 50. A number of laser pulses can be provided using multiple high energy pulsed lasers, using beam splitters, or any combination thereof. Suitable laser pulses can be provided by splitting one laser pulse into two or more laser pulses using one or more beam splitters. For example, at least one laser pulse can be split into three or more laser pulses using two or more beam splitters. Additional beam splitters can be used in like fashion to provide additional laser pulses. Suitable beam splitters include partial reflective, partial transmission mirrors, a number of which are commercially available from laser optics equipment manufacturers.

Positive ions can also be accelerated in a process comprising first providing n laser pulses, wherein n can be an integer greater than 1. A first n=1 laser pulse is directed to a first n=1 target at a time $t_1$ to give rise to positive ions emanating from the first n=1 target. Subsequently, the positive ions can be directed towards a series of additional n−1 targets so that the positive ions emanating from the first n=1 target arrive at an n=2 target at a time $t_2$ later than $t_1$. Thereafter, each of the other n−1 laser pulses are directed individually to each of the n−1 targets at a time $t_{n-1}$ to give rise to an electric field in each of the n−1 targets. The positive ions are then accelerated serially from target to target using the electric field arising from the interaction of each of the n−1 laser pulses with each of the n−1 targets. The n laser pulses can be provided by splitting a laser pulse generated by a laser into a series of n laser pulses using one or more beam splitters, by using at least two lasers, or any combination thereof. For example, n laser pulses can be provided to n targets using n lasers. Fewer than n lasers can be used in combination with one or more beam splitters to provide a total of n laser pulses for n targets. Any of a number of combinations of lasers and beam splitters are envisioned. Because the cost and complexity of suitable high energy pulsed lasers, in a preferred embodiment one high energy pulsed laser is used in connection with a series of beam splitters to provide n laser pulses to n targets to give rise to n stages of acceleration of positive ions.

Each of the other n−1 laser pulses can be delayed so as to arrive at its n−1 target at a time later than the arrival of the previous laser pulse at its previous target. This delay helps to ensure that the subsequent laser pulse arrives at the subsequent target at about the same time that the positive ions arrive at the subsequent target. The timing is selected to enable the subsequent pulse to interact with the subsequent metal target and the positive ions, which interaction gives rise to a further acceleration of the positive ions. Accordingly, the laser pulse may arrive at one of the later targets a little before, at the same time as, or little after when the positive ions arrive at the later target. Each of the other n−1 laser pulses can be delayed using a series of mirrors to increase the optical path of each of the other n−1 laser pulses. The optical path length of each laser pulse to its target can be longer than the optical path of its earlier laser pulse. This way, the finite speed of light, c, ensures that longer optical paths give rise to longer delays for the later laser pulses needed to arrive at their later targets to sufficiently interact with arriving positive ions. As with the earlier described method, this method can be readily adapted to include n being 2, or 3, or 4, or 5, or 6, or 7, or 8, or 9, or 10, or about 15, or about 20, or about 30, or about 40, or even about 50. Likewise, the laser pulse can be split into two or more laser pulses using one or more beam splitters. In addition, the laser pulse can be split into three or more laser pulses using two or more beam splitters. Suitable combination of laser pulses and targets are selected so that the positive ions emanating from the third target can be characterized as having an energy distribution peak that can be at least about 20% higher, or at least about 30% higher, or at least about 40% higher, or at least about 50% higher, or even at least about 60% higher as the energy distribution peak ("peak energy") of the positive ions emanating from the first target. In some cases where the peak energy of a subsequent laser is larger than that of a previous laser pulse, it is possible that the energy of the subsequent laser pulse will be even greater than 80% higher than the peak energy of the previous pulse, or even greater than 100% higher than the peak energy of the previous pulse. In embodiments wherein a laser pulse is split into two pulses that interact with the first and second targets, the positive ions emanating from the second target can be characterized as having an energy distribution peak that can be at least about 10% higher, or at least about 15% higher, or at least about 20% higher, or at least about 25% higher, or at least about 30% higher as the energy distribution peak of the positive ions emanating from the first target. As indicated above, the positive ions comprise hydrogen, boron, carbon, nitrogen, oxygen, an isotope of hydrogen, an isotope of boron, an isotope of carbon, an isotope of nitrogen, an isotope of oxygen, or any combination thereof. Similarly, the n=1 target can comprise a metal layer and at least one positive ion source layer comprising hydrogen, boron, carbon, nitrogen, oxygen, an isotope of hydrogen, an isotope of boron, an isotope of carbon, an isotope of nitrogen, an isotope of oxygen, or any combination thereof, the metal layer side of the target being oriented towards the at least one laser pulse. Suitable targets for n>1 do not necessarily comprise a positive ion source layer. Suitable targets for n>1 may be generally selected to contain essentially only the metal layer for the purposes of accelerating the positive ions that were generated at a previous target.

Systems for generating positive ions are also described. Suitable systems comprise at least one laser pulse source and a series of n−1 beam splitters capable of splitting a laser pulse emanating from the laser pulse source into n laser pulses, wherein n is greater than 1. A series of n targets are each oriented in an individual optical path that can be capable of interacting individually with each one of the individual laser pulses. In this regard, the first n=1 target is capable of giving rise to positive ions upon interaction with the n=1 laser pulse. The remaining n−1 targets are positionally situated to be capable of receiving the positive ions in series from a previous target. In this scenario each of the targets can be situated to be capable of interacting with a laser pulse to give rise to an electric field that is capable of accelerating the positive ions. To provide a suitable delay to the later laser pulses so that they arrive at a later time that coincides with the arrival of the accelerated positive ions, a series of n−1 optical delays can be situated in the optical path to give rise to a delay in each of the n−1 laser pulses arriving at each of the n−1 targets. Suitable optical path delays are described further in the examples below. The optical delays can be situated so that during operation, at least one of the laser pulses arrives at a target other than the first target at a time later than the arrival of the laser pulse at the first target. As described earlier, one or more of the optical delays may comprise a series of mirrors that increases the length of the optical path between one of the n−1 beam splitters and its target. Systems of the present invention may comprise any number of laser pulse-to-target coincident positive ion acceleration stages, for example, n can be 2, or 3, or 4, or 5, or 6, or 7, or 8, or 9, or 10, or about 15, or about 20, or about 30, or about 40, or even about 50. In certain preferred embodiments, n is typically in the range of from 2 to about 10, or even in the range of from 3 to 6.

As described above, the systems, methods and uses of the disclosed inventions utilize one or more high-power pulsed laser systems. Suitable pulsed lasers, as described hereinabove, wherein the laser pulse source can be capable of providing a laser intensity, I, of greater than about $10^{21}$ W/cm$^2$, or even greater than about $2\times10^{21}$ W/cm$^2$, or even greater than about $10^{22}$ W/cm$^2$. Suitable laser pulse sources also are capable of providing a laser pulse duration in the range of from about 1 femtosecond to about 1000 femtoseconds. Terawatt pulsed lasers meeting these criterion, are commercially available from Coherent, Inc., Santa Clara, Calif. 95054 USA, www.coherentinc.com.

In certain embodiments of the present invention a number of beam splitters can be used. For example, n−1 beam splitters can be selected to provide n laser pulses. In the situation where one laser pulse is split into n beams of equal intensity, then each of the beam will be characterized as having an intensity as $1/n^{th}$ the intensity of the laser pulse emanating from the laser pulse source.

Other variations on the systems for accelerating positive ions are also envisioned. For example, one system variation can include a series of n−1 beam splitters capable of splitting a laser pulse emanating from a laser pulse source into n laser pulses, wherein n can be greater than 1. In this variation, the laser pulse source can be separate from the system for accelerating positive ions. In this variation, a series of n targets can be oriented in an individual optical path capable of interacting individually with each one of the individual laser pulses. The first n=1 target is capable of giving rise to positive ions upon interaction with the n=1 laser pulse, wherein the remaining n−1 targets can be positionally situated to be capable of receiving the positive ions in series from a previous target. Accordingly, each of the targets can be capable of interacting with a laser pulse to give rise to an electric field capable of accelerating the positive ions. Finally, the system variation incorporates a series of n−1 optical delays are situated to give rise to a delay in each of the n−1 laser pulses arriving at each of the n−1 targets. The optical delays of this system variation can be situated so that during operation, at least one of the laser pulses arrives at a target at a time later than the arrival of the laser pulse at the first target. Any of a variety of optical delays can be incorporated in the system. For example, one or more of the optical delays may comprise a series of mirrors that increases the length of the optical path between one of the n−1 beam splitters and its target. As in the other systems described above, the number of laser pulses can vary widely. For example, n can be 2, or 3, or 4, or 5, or 6, or 7, or 8, or 9, or 10, or about 15, or about 20, or about 30, or about 40, or even about 50. Preferably, n can be in the range of from 2 to about 10, or even more preferably n can be in the range of from 3 to 6. The n−1 beam splitters can be selected to provide n laser pulses characterized as having an intensity of $1/n^{th}$ the intensity of the laser pulse emanating from the laser pulse source. The beam splitters can also be selected to provide pulses each characterized as having a different intensity. Suitable targets in the system variation can also make use of the targets as described earlier above. For example, at least one of the targets can comprise hydrogen, boron, carbon, nitrogen, oxygen, an isotope of hydrogen, an isotope of boron, an isotope of carbon, an isotope of nitrogen, an isotope of oxygen, or any combination thereof. And in certain preferred embodiments, the n=1 target comprises a metal layer and at least one positive ion source layer comprising hydrogen, boron, carbon, nitrogen, oxygen, an isotope of hydrogen, an isotope of boron, an isotope of carbon, an isotope of nitrogen, an isotope of oxygen, or any combination thereof, the metal layer side of the target being oriented towards the laser pulse source.

Another variation of a system for generating positive ions is described. This system comprises at least one laser pulse source to create a laser pulse. The system also comprises a series of n−1 beam splitters capable of splitting the laser pulse emanating from the laser pulse source into n laser pulses, wherein n can be greater than 1. Each of the n laser pulses is directed to a series of n targets capable of interacting with each laser pulse and generating an electric field in each of the n−1 targets. There is at least one optical path capable of directing a first n=1 laser pulse to a first n=1 target at a time $t_1$ to give rise to positive ions emanating from the first n=1 target. The system is further configured so that the positive ions are capable of being directed towards the additional n−1 targets, the positive ions emanating from the first n=1 target arriving at the n=2 target at a time $t_2$ later than $t_1$. In some embodiments, the system further comprises a series of n−1 optical delays capable of the delaying the n−1 laser pulses so as to arrive at their designated n−1 target at a time later than the arrival of the previous laser pulse at its previous target. For example, the optical delays may comprise a series of mirrors to increase the optical path of each of the other n−1 laser pulses, wherein the optical path of each laser pulse to its target can be longer than the optical path of its earlier laser pulse. As with the systems described above, any number of targets are envisioned, wherein n can be 2, or 3, or 4, or 5, or 6, or 7, or 8, or 9, or 10, or about 15, or about 20, or about 30, or about 40, or even about 50. Preferably, n can be in the range of from 2 to about 10, or even more preferably n can be in the range of from 3 to 6. Lower values of n give rise to systems of lower complexity, which may have an advantage with respect to manufacturing issues. Accordingly, in lower complexity systems having fewer than about six laser-target interaction stages, such systems can be capable of giving rise to an energy distribution of positive ions emanating from the n=3 target being characterized as having an energy distribution peak that can be at least about 20% higher, or at least about 30% higher, or at least about 40% higher, or at least about 50% higher, or even at least about 60% higher than the energy distribution peak of the positive ions emanating from the n=1 target. Similarly, such lower complexity systems can be capable of giving rise to an energy distribution of positive ions emanating from the n=2 target being at least about 10% higher, or at least about 15% higher, or at least about 20% higher, or at least about 25% higher, or at least about 30% higher than the energy distribution peak of the positive ions emanating from the n=1 target. Target materials will typically comprise a combination or a layered structure composed of a metal for creating an intense electric field when interacting with a high-intensity laser pulse, as well as atoms suitable for creating the positive ions, as described herein above.

In another variation, there is provided a system for generating positive ions, which system comprises n laser pulse sources capable of generating n laser pulses, wherein n can be greater than 1. The system also includes a series of n targets each being oriented in an individual optical path that can be capable of interacting individually with each one of the individual n laser pulses. In this system, the first n=1 target is a capable of giving rise to positive ions upon interaction with the n=1 laser pulse, wherein the remaining n−1 targets can be positionally situated to be capable of receiving the positive ions in series from a previous target. Accordingly, each of the targets are capable of interacting with a laser pulse to give rise to an electric field capable of accelerating the positive ions. In this system, it is desirable that the individual laser pulses are timed so that they each arrive at their respective targets at the appropriate time to give rise to an acceleration of the positive ions.

The timing of the individual laser pulses can be achieved by incorporating delay circuitry capable of delaying the generation of at least one of the n−1 laser pulses relative to the n=1 laser pulse. Suitable delay circuitry includes electronic timers that are capable of controlling the generation of a series of laser pulses that are separated in time a mere fractions of a second. For example, consider a system comprising to laser pulse sources, each positioned 1 meter from its target, and the second target is positioned 1 meter from first target. The delay circuitry is designed to fire the second laser pulse at a time corresponding to the amount of time that it takes for the positive ions to travel from the first target (where they are generated) to the second target. For high-energy positive ions, e.g., relativistic positive ions, the speed of the positive ions is less than about the speed of light, c, or about $3\times10^8$ meters per second. Accordingly, the delay circuitry in this situation would fire the second laser at a time later than the first laser, this later time being in the range of from about $10^{-9}$ seconds to about $10^{-6}$ seconds, or preferably being in the range of from about $10^{-8}$ seconds to about $10^{-7}$ seconds. If the distance between the targets is longer than about a meter, then the time delay will be on the longer side of this range. Conversely if the distance between the targets is shorter than about a meter, then the time delay will be on the shorter side of this range. Likewise slower moving positive ions will require a longer time delay, and fast moving positive ions will require a shorter time delay. In additional variations, systems comprising two or more laser sources may also incorporate at least one beam splitter capable of splitting at least one laser pulse into at least two laser pulses.

Optical delays can be situated to give rise to a delay in at least one laser pulse arriving at its target. As described above in the other variations of the system, at least one optical delay can be situated so that during operation, at least one of the laser pulses arrives at a target other than the first target at a time later than the arrival of the laser pulse at the first target. Suitable optical delays may comprise a series of mirrors that increases the length of the optical path between one of the laser pulse sources and its corresponding target. Any number of laser pulse sources can be used, for example n can be 2, or 3, or 4, or 5, or 6, or 7, or 8, or 9, or 10, or about 15, or about 20, or about 30, or about 40, or even about 50. Preferably, n can be in the range of from 2 to about 10, and even more preferably n can be in the range of from 3 to 6 in order to minimize the cost and expense of using a plurality of laser pulse sources. Suitable laser pulse source can be capable of providing a laser intensity, I, of greater than about $10^{21}$ W/cm$^2$, which are commercially available as described herein above. Suitable laser pulse sources are also capable of providing a laser pulse duration in the range of from about 1 femtosecond to about 1000 femtoseconds. Suitable targets for the system variation are described herein above.

EXAMPLES AND ADDITIONAL ILLUSTRATIVE EMBODIMENTS

Multi-stage proton acceleration in 2D particle-in-cell simulations and 3D model. 2D PIC simulations were used to model the interaction between the laser pulse and several targets. The initial conditions were chosen to correspond to realistic experimental parameters, where the relativistically intense ($I_0=1.92\times10^{21}$ W/cm$^2$, $\lambda$=800 nm), ultrashort ($L_p$~30 fs) laser pulse interacts with a copper, Cu, target of thickness 400 nm. The electron density as well as the ion charge state in the target is $n_e=3.2\times10^{22}$ $cm^{-3}$ and $Z_i=4$ correspondingly. A 200 nm thick hydrogen-rich layer ($n_e=6\times10^{19}$ $cm^{-3}$) is initially located at the back surface of the target. Two and three interaction stages have been designed and simulated and the final positive ion energy (averaged over all positive ions) has been compared to that obtained in a single interaction scheme. A schematic diagram of multi-stage interaction setup is shown in FIG. 1. In the multiple interaction scheme, the laser pulse of intensity $I_0$ is split into n sub-pulses of equal intensity $I_0/n$ that is made to interact with n targets. Calculations in these examples were carried out using hydrogen positive ions (i.e., protons). Additional calculations can be readily carried out on other positive ions. The positive ion layer is located at the back surface of the first target. The other targets are composed mainly of metal and have little or no contaminant hydrogen-containing materials.

Referring to FIG. 1(*a*), there is provided a prior art system, which comprises a laser pulse 22 of intensity $I_0$ interacting with a metal target 24 having a positive ion source layer 26 positioned on the back of the metal target. Laser accelerated positive ions 28 of energy (e.g., temperature) $T_0$ are shown emanating from the target, which comprises both the metal portion in the positive ion layer.

Referring to FIG. 1(*b*), there is provided a two-stage interaction system 100. This system shows a first laser pulse 102 interacting with a first metal target 104, on the back of which target is absorbed a positive ion source layer 106. Positive ions 108 from the positive ion source layer are shown being generated and accelerated from the first target. The laser accelerated positive ions 108 arrive at the second metal target 114 at a time to coincide with the arrival of the second laser pulse 112. Without being bound by any particular theory of operation, the interaction of the electric field generated in the a second metal target by the laser pulse further accelerates the positive ions. This is illustrated by the laser accelerated positive ions of stage two 116, having energy vector of 118.

Referring to FIG. 1(*c*), there is provided a three stage interaction system 120. This system illustrates a first laser pulse 122 interacting with a first metal target 124, on the back of which is provided a positive ion source layer 126. The interaction between the first laser pulse, the first metal target, and the positive ion source layer gives rise to laser accelerated positive ions 128. A moment later, the positive ions generated at the first target arrive at the second metal target 134, coincidentally with the arrival of the second laser pulse 132. This stage two interaction gives rise to a further acceleration of the positive ions as shown in the stage two laser accelerated positive ions 136, having energy vector 138. Subsequently, the stage two laser accelerated positive ions 136 arrive at the stage three metal target 144, coincidentally with the arrival of the third laser pulse 142. The interaction of the stage two laser accelerated positive ions, the third laser pulse and the third metal target gives rise to an even further acceleration of the positive ions, as indicated by the stage three laser accelerated positive ions 146 having energy vector 148.

Figure 2:
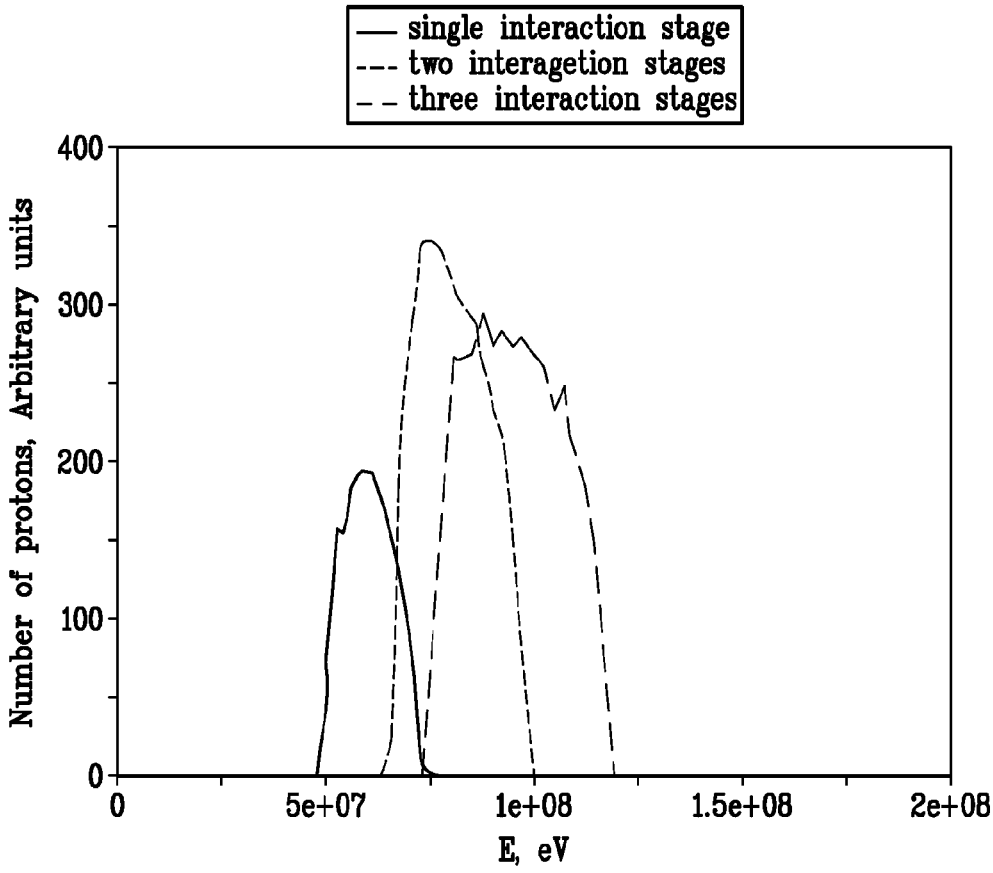
FIG. 2 depicts examples of energy distributions of positive ions (protons in these examples) for three different interaction stages; solid line represents a prior art single interaction stage (one laser pulse or no laser splitting), dotted line represents a double interaction stage (single laser splitting) according to an embodiment of the present invention; and dashed line represents a triple interaction stage (double laser splitting) according to an embodiment of the present invention.

In the two-stage setup, the positive ion (e.g., proton) layer is accelerated by the electrostatic field developed through the interaction of the first laser sub-pulse with the first metal target substrate. The second laser sub-pulse travels to the second target, interacts with it and sets up a longitudinal electric field. The traveling positive ion layer passes through the second substrate and gets an extra boost from this electric field. The arrival time for the second laser sub-pulse at the second target is adjusted so that the positive ion layer gets an appreciable energy increase. It should be noted that the arrival time of the second laser sub pulse in the positive ions do not necessarily need to be exactly the same. For example, it may be advantageous to do additional fine-tuning of the system. For example, it may be advantageous that the second (i.e. later) laser sub pulse arrives a little before or a little after the arrival of the positive ions. One of ordinary skill in the art would be readily able to carry out these adjustments. The results of PIC simulations show that with the two-stage splitting the final average energy of the accelerated positive ions reaches $E_p^{(2)}=81.5$ MeV, as opposed to $E_p^{(2)}=60.5$ MeV (where the superscript denotes the number of interaction stages) for the conventional single target assembly, which is an increase of ~35%. Using the procedure described above, a 3-stage interaction scheme was also designed and simulated, in which case the main laser pulse is split into three sub-pulses of equal intensity $I=I_0/3$ that is made to interact with three targets with the same physical parameters described above. The final average positive ion energy in this 3-stage setting reaches $E_p^{(3)}=96.5$ MeV, which is ~60% energy increase as compared to the single interaction case or ~19% as compared to the 2-stage procedure. FIG. 2 also shows the positive ion energy distributions for the three interaction stages. Gradual increase in the peak positive ion energy is readily observed.

Figure 3:
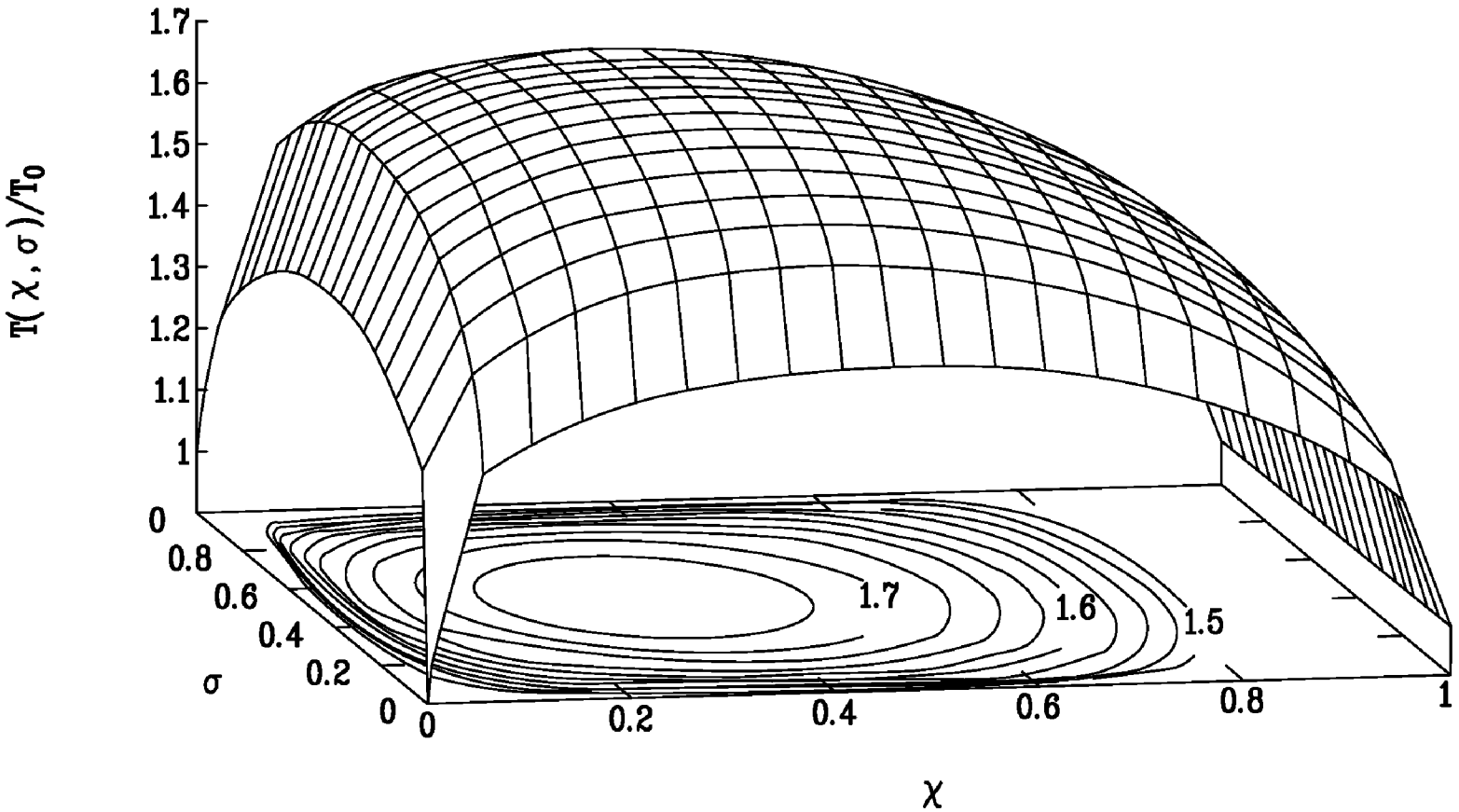
FIG. 3 illustrates peak positive ion energy (in this case, the peak in the final average proton energy) as a function of the splitting ratio parameters, $\chi$ and $\sigma$, normalized to the peak positive ion energy ($T_0$) obtained from a single interaction stage.
Figure 4:
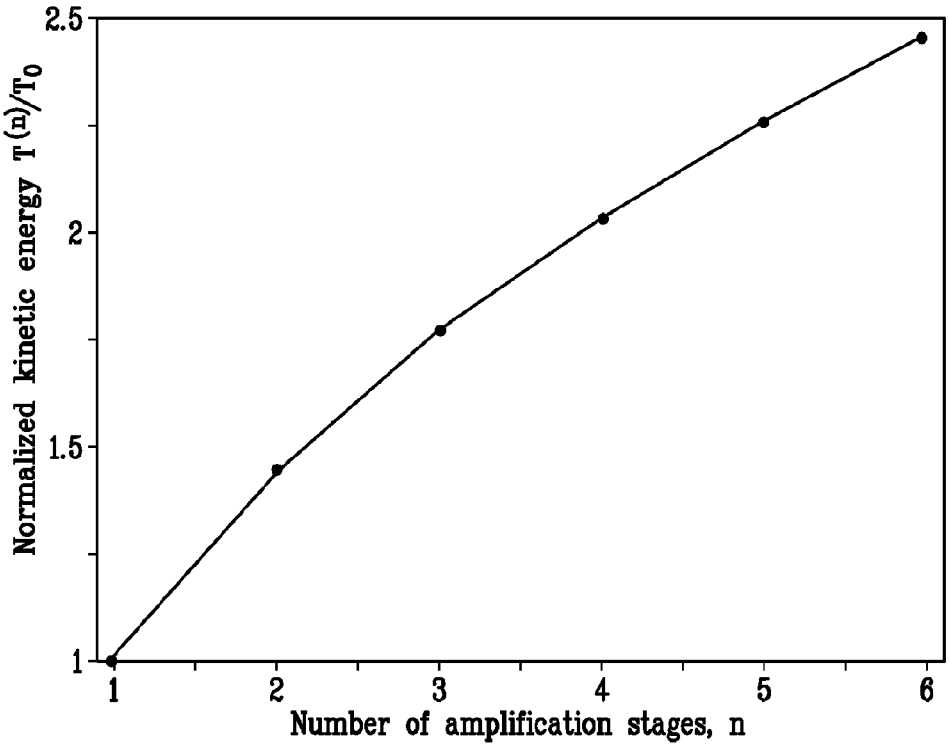
FIG. 4 illustrates peak positive ion energy (in this case, the peak in the final average proton energy) as a function of the number of amplification stages, n.

As the number of splits n increases the final positive ion energy gradually increases. Increasing the number of interaction stages typically yields higher positive ion energies. The number of interaction stages are increased as long as the intensity of the laser sub-pulses are high enough so that the laser ponderomotive force can still push electrons out of the target, thus setting up an accelerating electric field for positive ions. For estimation purposes, the number of splits or stages is approximated by, $n\sim a_0^2$, where $a_0=eE/(mc\omega)$ is the laser relativistic parameter. A model developed for the longitudinal electric field is used to determine the positive ion energy as a function of n, where n>3, as well as the splitting ratio between laser sub-pulses. The model is based on approximating the accelerating electric field by that of a charged cylinder of radius a and thickness $2r_0$. This model has the following mathematical form (on the cylinder's axis x), $$E(x,t)=\frac{kQ_0\eta\left(t-\frac{|x|}{c}\right)}{a^2r_0}\left[\sqrt{(x-r_0)^2+a^2}-\sqrt{(x+r_0)^2+a^2}+2x\begin{cases}1, & |x|\le r_0\\ r_0/|x|, & |x|>r_0\end{cases}\right] \tag{1}$$

where $Q_0$ is the charge of the target if all electrons are expelled, and $\eta(t)$ is the proportion of the expelled electrons as a function of time that can be approximated by the following expression, $$\eta(t)=\gamma\begin{cases}e^{-\alpha(t-t_0)^2}, & t\le t_0\\ \delta+(1-\delta)e^{-\beta(t-t_0)}, & t>t_0\end{cases}, \tag{2}$$

where $\gamma$ is the fraction of the electrons expelled at the peak of the laser pulse, $\delta$ is the fraction of the initially expelled electrons that never return to the target, $t_0$ is the arrival time of the peak of the laser pulse at the target, $\alpha=4\ln 2/\tau^2$ is a constant that depends on the pulse width (FWHM) used in the PIC simulation, $\beta$ is the rate of return of the expelled electrons. These numerical factors are functions of laser intensity and have been tabulated using the PIC simulations. The equation of motion for a positive ion interacting with the field distribution (1) can be expressed as:

$$\frac{d}{dt}\left(\frac{v}{\sqrt{1-v^2/c^2}}\right)=\frac{e}{m_p}E(x,t), \tag{3a}$$

$$\frac{d}{dt}x(t)=v(t), \tag{3b}$$

where $m_p$ is the positive ion mass, and e is the elementary charge. Eqs. (3) have been solved numerically for a wide range of splitting ratios $\chi$ and $\sigma$ in the three-stage interaction scheme, wherein $\chi=I_1/I_0$ ($I_1$ is the intensity of the first laser sub-pulse) and $\sigma=I_2/((1-\chi)I_0)$ ($I_2$ is the intensity of the second laser sub-pulse). FIG. 3 shows the final average proton energy as a function of the splitting ratio parameters normalized to the proton energy obtained from a single interaction stage. The maximum in the proton energy (i.e., peak positive ion energy, in this example the positive ions are protons) occurs when $\chi=1/3$ and $\sigma=1/2$ (corresponding to three laser sub-pulses with equal intensities $I_0/3$). Other combinations of splitting ratios lead to lower final positive ion energy. It should be noted that the two-stage results are recovered from this figure when one of the splitting parameters ($\chi$, $\sigma$) is equal to 0 or 1. In this case, the maximum in positive ion energy is reached at equal splitting of the laser pulse into two sub-pulses with intensity $I_0/2$. Using Eqs. 3a and 3b, the final positive ion energy is seen to depend on the number of amplification stages, shown in FIG. 4. This data shows generally that the final positive ion energy increases with the number of splitting stages.

Figure 5B:
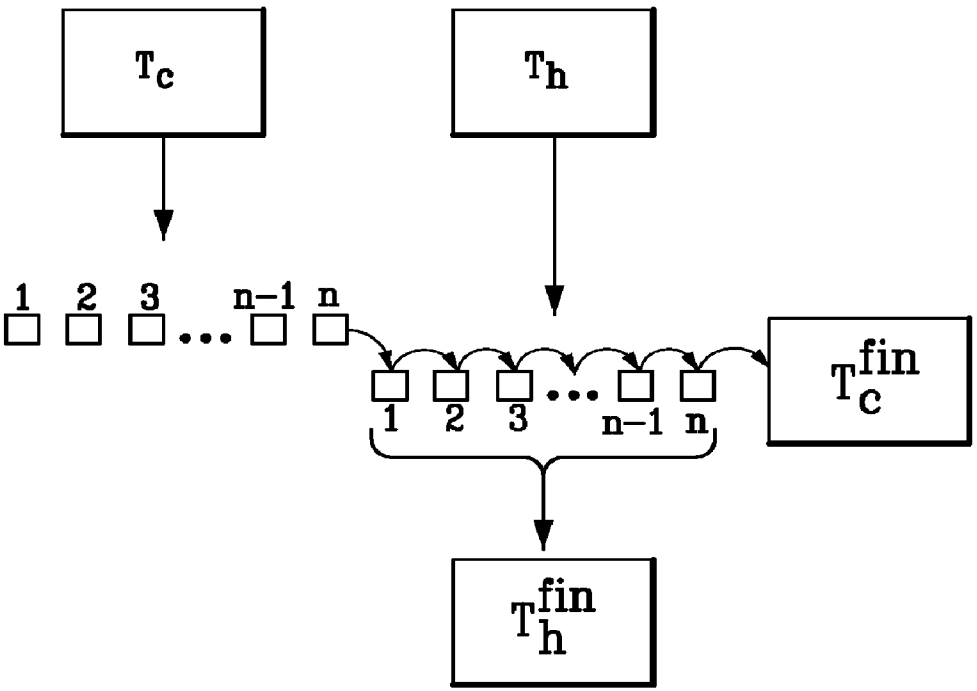
FIG. 5 provides two schematic diagrams for two heat exchange processes; a) the hot and cold reservoirs are put into thermal contact with each other leading to temperature equalization; the entropy gain is maximal for this process; b) the hot and cold reservoirs are split into n pieces each that are put into thermal contact with each other in a sequential manner; the limit $n \rightarrow \infty$, corresponds to reversible heat exchange process with zero entropy gain.
Figure 5A:
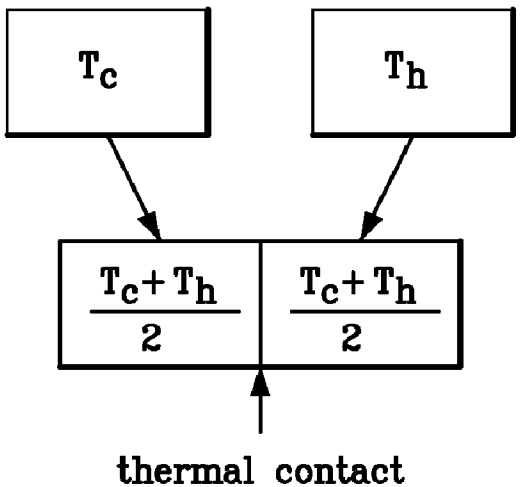

Perfect Heat Exchange Problem. As described above, positive ion acceleration by high power lasers can be qualitatively viewed from the perspective of the problem of energy exchange between hot (with initial temperature $T_h$) and cold (with initial temperature $T_c$) reservoirs. The problem at hand may be formulated as follows: what is an efficient method of exchanging the energy between the hot and cold objects, so that in the end the initially hot object becomes cold and initially cold object becomes hot? Without being bound by any particular theory of operation, one way to exchange heat between objects is by placing them in thermal contact with each other, so that in the end their final temperature will be half of the sum of their initial temperatures (for a sake of simplicity we shall assume that both objects have the same size and mass and consist of an ideal gas). The entropy change for this particular process corresponds to a maximum in the entropy gain, making it completely irreversible and least efficient in the sense of energy exchange between both objects. From a thermodynamic point of view, the efficiency of the energy transfer from the hot object to the cold is at a maximum for those processes for which the entropy change tends to zero. Therefore, the problem is reduced to finding those processes which minimize the entropy gain. Initially hot and cold reservoirs are split into n equal pieces each and subsequently every individual hot piece is put into thermal contact with each individual cold piece (without mixing them) in a sequential manner as shown in FIG. 5. Solving the thermal balance equations for this system results in the final temperature of initially hot/cold objects (formed by putting back together initially hot/cold pieces to form new cold/hot objects) being smaller/greater than $(T_h+T_c)/2$. The general expression for the final temperature of initially hot/cold reservoirs for n equal splittings can be given by the following expressions:

$$T_h^{(fin)}=\frac{\sum_{i=1}^{n}(\delta_{i,n}T_c+\delta_{n,i}T_h)}{n}, \tag{4a}$$

$$T_c^{(fin)}=\frac{\sum_{i=1}^{n}(\delta_{i,n}T_h+\delta_{n,i}T_c)}{n}, \tag{4b}$$

$$\delta_{i,j}=\frac{1}{2^{i+j}(i-1)!}\sum_{k=1}^{j}2^k\frac{(i+j-k-1)!}{(j-k)!}$$

In the limit $n\to\infty$, $T_h^{(fin)}=T_c$ and $T_c^{(fin)}=T_h$ and a perfect heat exchange process between hot and cold objects is established. Assuming that both objects are an ideal gas, the entropy change for the process involving n equal splittings has the following form:

$$\Delta S=C_p\ln\left[\frac{\prod_{i=1}^{n}(\delta_{i,n}T_h+\delta_{n,i}T_c)(\delta_{i,n}T_c+\delta_{n,i}T_h)}{T_h^nT_c^n}\right]\Big/n \tag{8}$$

where $C_p$ is the specific heat capacity of the material. Again, in the limit $n\to\infty$, the entropy change $\Delta S\to 0$, which signifies that completely reversible energy exchange process between both objects may be established in this limit. At this point it should be noted that even though an ideal gas was used in the calculation of the entropy change, the same conclusion can be drawn if one were to use any other system.

The main conclusion that one can draw from this example is that splitting of the single interaction stage into multiple sub-stages is an effective way of reducing an irreversible component in the total interaction cycle no matter how this interaction looks like (laser-matter or matter-matter), thus increasing the effectiveness of the "pump". Thus, without being limited to any theory of operation, this is the reason why the splitting procedure should also lead to higher positive ion energies in the laser-matter interaction experiments, since it increases the effectiveness of the energy transfer from the laser pulse to positive ions.

Figure 6:
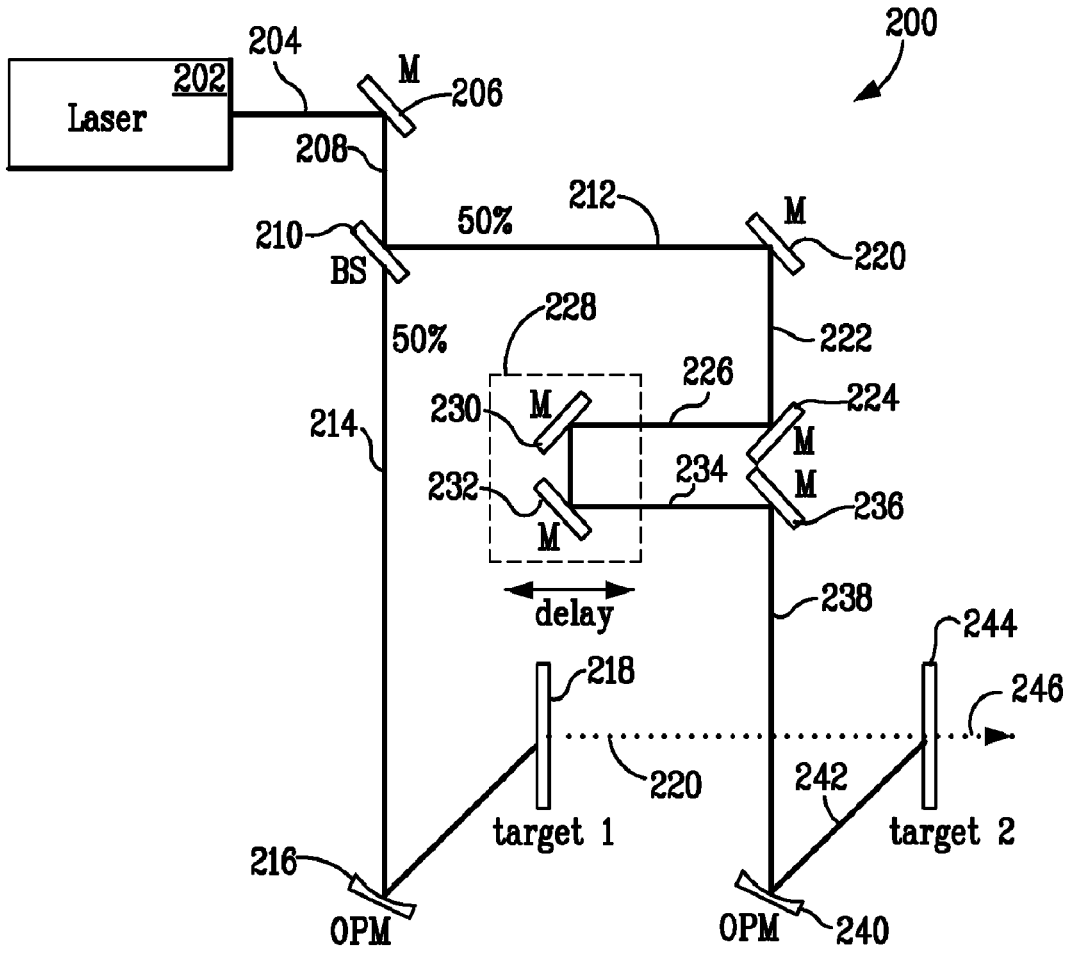
FIG. 6 illustrates an embodiment of a system according to the present invention that comprises two interaction stages (double laser splitting)

An embodiment of a system according to the present invention that incorporates two interaction stages (double laser splitting) is described in FIG. 6. This two stage accelerator 200 is shown comprising an intense light pulse source (e.g., a high power laser 202), an optical path showing the path of the light pulses (the dark lines 204, 208, 212, 214, 222, 226, 234, 238, 242), mirrors ("M" 206, 220) for deflecting the laser light pulses, a beam splitter ("BS" 210) for splitting the light pulse 208 into two distinct light pulses 212, 214 of approximately the same intensity (in this case the light pulses exiting the beam splitter 210 each comprise about 50 percent of the intensity of the pulse entering the BS 210 from light pulse 208, two off-axis parabolic mirrors ("OPM" 216, 240) for directing the laser pulses to two separate targets 218, 244 (target 1, target 2), an adjustable optical delay 228 comprising a series of mirrors 230, 232 and an adjustable path length 224, 226, 234, 236 for delaying the arrival of the light pulse arriving at target 2. Accelerated positive ions (dotted line 220) originating in target 1 are directed towards target 2 244. Positive ions generated at target 1 arrive a moment later at target 2, at which time the laser pulse 238 that has been delayed using the optical delay 228 reflects off a second OPM 240 and arrives at target 2 244. The optical delay is adjusted to maximize the coupling of the generated electric field in target 2 244 with the positive ions arriving at target 2. The energy of the positive ion beam emanating from target 2 (dotted line and arrow 246) is of higher energy relative to the positive ion beam energy emanating from target 1.

Figure 7:
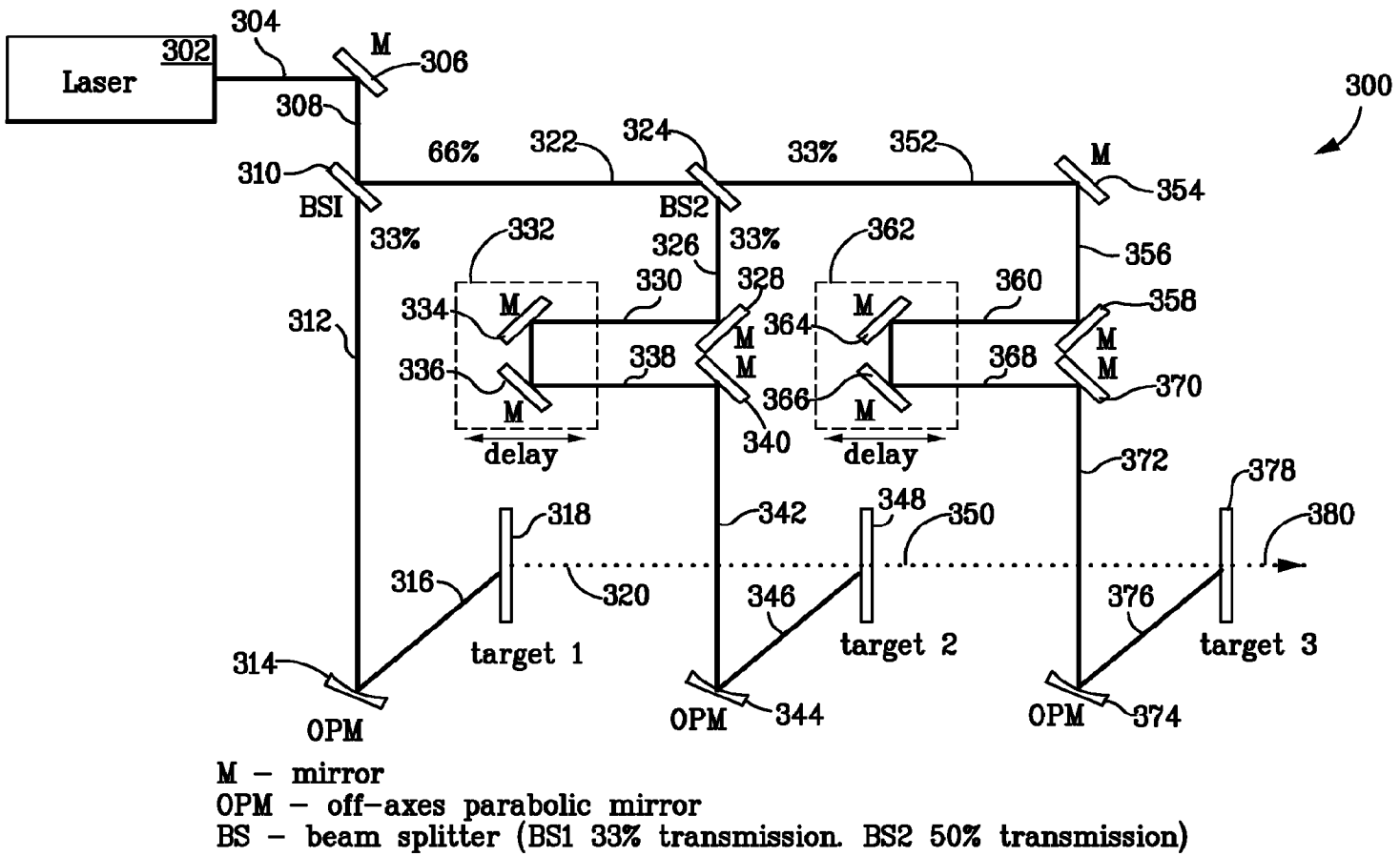
FIG. 7 illustrates an embodiment of a system according to the present invention that comprises three interaction stages (triple laser splitting).

An embodiment of a system according to the present invention that incorporates three interaction stages (triple laser splitting) is shown in FIG. 7. This three stage accelerator 300 is shown comprising an intense light pulse source (e.g., a high power laser) 302, an optical path (the dark lines 304, 308, 312, 316, 322, 326, 342, 346, 352, 356, 372, 376), mirrors ("M") 306, 354 for deflecting the light pulse, two beam splitters ("BS1, BS2") 310, 324 for splitting the light pulse into three distinct light pulses of approximately the same intensity. In this case the light pulses exiting BS1 310 comprises a 66% beam 322 and a 33% beam 312. The 66% beam 322 is further split by about 50 percent of the original intensity into two beams 326, 352, each of which also comprises about 33% of the original beam 304. Three off-axis parabolic mirrors ("OPM") 314, 344, 374 for directing the laser pulses 316, 346, 376 to three separate targets (target 1 318, target 2 348, and target 3 378), two adjustable optical delays 332, 362 each comprising a series of mirrors 328, 334, 336, 340, 358, 364, 366, 370 and an adjustable path length 330, 338, 360, 368 for delaying the arrival of the light pulse arriving at targets 2 348 and 3 378, respectively. Accelerated positive ions (dotted line) 320 originating in target 1 318 are directed towards target 2 348. Positive ions generated at target 1 318 arrive a moment later at target 2 348, at which time the light pulse 342 that has been delayed using the first optical delay 332 reflects off a second OPM 344 and arrives at target 2 348. The first optical delay 332 is adjusted to maximize the coupling of the generated electric field in target 2 348 with the positive ions 320 arriving at target 2. The energy of the positive ion beam emanating from target 2 (dotted line 350) is of higher energy relative to the positive ion beam energy emanating from target 1. Then, accelerated positive ions (dotted line 350) originating in target 2 348 are directed towards target 3 378. Positive ions accelerated at target 2 348 arrive a moment later at target 3 378, at which time the light pulse 372 that has been delayed using the second optical delay 362 reflects off a third OPM 374 and arrives at target 3 378. The second optical delay 362 is adjusted to maximize the coupling of the generated electric field in target 3 378 with the positive ions emanating from target 2 348. The energy of the positive ion beam 380 emanating from target 3 (dotted line and arrow) is of higher energy relative to the positive ion beam energy emanating from target 2 348.

In several examples, increasing the acceleration of protons (i.e., hydrogen positive ions) with high-power lasers has been analyzed using 2D PIC simulations and an analytical 3D model. The results described herein show that significant energy gain in the final proton energy is possible if one introduces a multistage interaction scheme as opposed to a conventional single laser/target interaction setup. Many recent investigations concerning the proton acceleration have examined the kinematic/dynamic aspect of this problem, specifically the underlying physics of particle acceleration. As shown in the present invention, the multistage interaction model offers significant gains in the efficiency of energy transfer from the laser to accelerated particles. A thermodynamic model has been offered to elucidate this effect. According to the model, the splitting of a single interaction site into multiple stages is an effective way of reducing an irreversible component in the energy exchange process between the laser and target. As a result, more laser energy is transformed into proton kinetic energy. It was shown that in a three-stage setting, there is ≈60% increase in the energy efficiency of the laser accelerator as compared to a single interaction scheme. At the same time according to the results of our 3D model, it should be possible to increase the energy efficiency by more than 100% for a six-stage interaction setting without the need for more powerful lasers. Based on these results it is concluded that the multi-staging procedure represents a step forward towards increasing the energy efficiency of laser-ion accelerators with the potential of achieving significant increase in the final ion energies suitable for practical applications.

What is claimed:

1. A method of generating positive ions, comprising:

directing at least one laser pulse to a first target to give rise to positive ions emanating from the first target, the positive ions being directed towards a second target;

directing at least one other laser pulse to a second target to give rise to an electric field capable of further accelerating the positive ions arriving at the second target; and accelerating the positive ions using the electric field arising from the interaction of the at least one other laser pulse with the second target.

2. The method of claim 1, wherein the positive ions emanating from the first target are characterized as having an energy distribution peak in the range of from about 10 MeV to about 100 MeV.

3. The method of claim 1, wherein the positive ions emanating from the second target are characterized as having an energy distribution peak in the range of from about 20 MeV to about 200 MeV.

4. The method of claim 1, wherein the laser pulses are provided by using a plurality of lasers, splitting a laser pulse into two or more subpulses, or any combination thereof.

5. The method of claim 1, wherein the at least one other laser pulse is delayed so as to arrive at the second target at a time later than the arrival of the laser pulse at the first target.

6. The method of claim 5, wherein the at least one other laser pulse is delayed using a series of mirrors to give rise to the optical path of the at least one other laser pulse arriving at the second target being longer than the optical path of the at least one laser pulse arriving at the first target.

7. The method of claim 1, wherein at least 2 laser pulses are used to generate the positive ions.

8. The method of claim 7, wherein the positive ions emanating from the second target are characterized as having an energy distribution peak that is at least about 20% higher than the energy distribution peak of the positive ions emanating from the first target.

9. The method of claim 7, wherein at least three laser pulses and three targets are used in series to generate the positive ions, wherein the positive ions emanating from the third target are characterized as having an energy distribution peak that is at least about 20% higher than the energy distribution peak of the positive ions emanating from the first target.

10. The method of claim 1, wherein the at least one laser pulse is split into two or more laser pulses using one or more beam splitters.

11. The method of claim 10, wherein the at least one laser pulse is split into three or more laser pulses using two or more beam splitters.

12. The method of claim 11, wherein the positive ions emanating from the third target are characterized as having an energy distribution peak that is at least about 20% higher than the energy distribution peak of the positive ions emanating from the first target.

13. The method of claim 1, wherein the positive ions emanating from the second target are characterized as having an energy distribution peak that is at least about 10% higher than the energy distribution peak of the positive ions emanating from the first target.

14. The method of claim 1, wherein the positive ions comprise hydrogen, boron, carbon, nitrogen, oxygen, an isotope of hydrogen, an isotope of boron, an isotope of carbon, an isotope of nitrogen, an isotope of oxygen, or any combination thereof.

15. The method of claim 1, wherein the first target comprises a metal layer and at least one positive ion source layer comprising hydrogen, boron, carbon, nitrogen, oxygen, an isotope of hydrogen, an isotope of boron, an isotope of carbon, an isotope of nitrogen, an isotope of oxygen, or any combination thereof, the metal layer side of the target being oriented towards the at least one laser pulse.

16. The method of claim 15, wherein the at least one positive ion source layer comprises a hydrogen-rich layer, a deuterium-rich layer, a boron-rich layer, a carbon-rich layer, a nitrogen-rich layer, an oxygen-rich layer, or any combination thereof.

17. A method of accelerating positive ions, comprising:

a) providing n laser pulses, wherein n is an integer greater than 1;

b) directing a first n=1 laser pulse to a first n=1 target at a time $t_1$ to give rise to positive ions emanating from the first n=1 target, the positive ions being directed towards a series of additional n−1 targets, the positive ions emanating from the first n=1 target arriving first at the n=2 target at a time $t_2$ later than $t_1$;

c) directing each of the other n−1 laser pulses individually to each of the n−1 targets at a time $t_{n-1}$ to give rise to an electric field in each of the n−1 targets; and d) accelerating the positive ions serially from target to target using the electric field arising from the interaction of each of the n−1 laser pulses with each of the n−1 targets.

18. The method of claim 17, wherein the n laser pulses are provided by splitting a laser pulse generated by a laser into a series of n laser pulses using one or more beam splitters, by using at least two lasers, or any combination thereof.

19. The method of claim 17, wherein each one of the other n−1 laser pulses is delayed so as to arrive at its n−1 target at a time later than the arrival of the previous laser pulse at its previous target.

20. The method of claim 19, wherein each one of the other n−1 laser pulses is delayed using a series of mirrors to increase the optical path of each of the other n−1 laser pulses, wherein the optical path of each laser pulse to its target is longer than the optical path of its earlier laser pulse.

21. The method of claim 17, wherein n is in the range of from 2 to about 50.

22. The method of claim 17, wherein the laser pulse is split into two or more laser pulses using one or more beam splitters.

23. The method of claim 22, wherein the laser pulse is split into three or more laser pulses using two or more beam splitters.

24. The method of claim 23, wherein the positive ions emanating from the third target are characterized as having an energy distribution peak that is at least about 20% higher than the energy distribution peak of the positive ions emanating from the first target.

25. The method of claim 17, wherein the positive ions emanating from the second target are characterized as having an energy distribution peak that is at least about 10% higher than the energy distribution peak of the positive ions emanating from the first target.

26. The method of claim 17, wherein the positive ions comprise hydrogen, boron, carbon, nitrogen, oxygen, an isotope of hydrogen, an isotope of boron, an isotope of carbon, an isotope of nitrogen, an isotope of oxygen, or any combination thereof.

27. The method of claim 17, wherein the n=1 target comprises a metal layer and at least one positive ion source layer comprising hydrogen, boron, carbon, nitrogen, oxygen, an isotope of hydrogen, an isotope of boron, an isotope of carbon, an isotope of nitrogen, an isotope of oxygen, or any combination thereof, the metal layer side of the target being oriented towards the at least one laser pulse.

28. A system for generating positive ions, comprising:

at least one laser pulse source;

a series of n−1 beam splitters capable of splitting a laser pulse emanating from the laser pulse source into n laser pulses, wherein n is greater than 1;

a series of n targets each being oriented in an individual optical path that is capable of interacting individually with each one of the individual laser pulses, the first n=1 target capable of giving rise to positive ions upon interaction with the n=1 laser pulse, wherein the remaining n−1 targets are positionally situated to be capable of receiving the positive ions in series from a previous target, wherein each one of the targets is capable of interacting with a laser pulse to give rise to an electric field capable of accelerating the positive ions; and a series of n−1 optical delays situated to be capable of giving rise to a delay in each of the n−1 laser pulses arriving at each of the n−1 targets.

29. The system of claim 28, wherein the optical delays are situated so that during operation, at least one of the laser pulses arrives at a target other than the first target at a time later than the arrival of the laser pulse at the first target.

30. The system of claim 28, wherein one or more of the optical delays comprises a series of mirrors that increases the length of the optical path between one of the n−1 beam splitters and its target.

31. The system of claim 28, wherein n is in the range of from 2 to about 50.

32. The system of claim 28, wherein n is in the range of from 2 to about 10.

33. The system of claim 32, wherein n is in the range of from 3 to 6.

34. The system of claim 28, wherein the laser pulse source is capable of providing a laser intensity, I, of greater than about $10^{21}$ W/cm$^2$.

35. The system of claim 28, wherein the laser pulse source is capable of providing a laser pulse duration in the range of from about 1 femtosecond to about 1000 femtoseconds.

36. The system of claim 28, wherein the n−1 beam splitters are selected to provide n laser pulses characterized as having an intensity of $1/n^{th}$ the intensity of the laser pulse emanating from the laser pulse source.

37. The system of claim 28, wherein at least one target is selected to give rise to positive ions emanating from the target, the target comprising hydrogen, boron, carbon, nitrogen, oxygen, an isotope of hydrogen, an isotope of boron, an isotope of carbon, an isotope of nitrogen, an isotope of oxygen, or any combination thereof.

38. The system of claim 28, wherein the n=1 target comprises a metal layer and at least one positive ion source layer comprising hydrogen, boron, carbon, nitrogen, oxygen, an isotope of hydrogen, an isotope of boron, an isotope of carbon, an isotope of nitrogen, an isotope of oxygen, or any combination thereof, the metal layer side of the target being oriented towards the laser pulse source.

39. A system for accelerating positive ions, comprising:

a series of n−1 beam splitters capable of splitting a laser pulse emanating from a laser pulse source into n laser pulses, wherein n is greater than 1;

a series of n targets, each one being oriented in an individual optical path that is capable of interacting individually with each one of the individual laser pulses, the first n=1 target capable of giving rise to positive ions upon interaction with the n=1 laser pulse, wherein the remaining n−1 targets are each positionally situated to be capable of receiving the positive ions in series from a previous target, wherein each one of the targets is capable of interacting with a laser pulse to give rise to an electric field capable of accelerating the positive ions; and a series of n−1 optical delays situated to be capable of giving rise to a delay in each of the n−1 laser pulses arriving at each of the n−1 targets.

40. The system of claim 39, wherein the optical delays are situated so that during operation, at least one of the laser pulses arrives at a target at a time later than the arrival of the laser pulse at the first target.

41. The system of claim 39, wherein one or more of the optical delays comprises a series of mirrors that increases the length of the optical path between one of the n−1 beam splitters and its target.

42. The system of claim 39, wherein n is in the range of from 2 to about 50.

43. The system of claim 39, wherein n is in the range of from 2 to about 10.

44. The system of claim 43, wherein n is in the range of from 3 to 6.

45. The system of claim 39, wherein the n−1 beam splitters are selected to provide n laser pulses characterized as having an intensity of $1/n^{th}$ the intensity of the laser pulse emanating from the laser pulse source.

46. The system of claim 39, wherein at least one of the targets comprise hydrogen, boron, carbon, nitrogen, oxygen, an isotope of hydrogen, an isotope of boron, an isotope of carbon, an isotope of nitrogen, an isotope of oxygen, or any combination thereof.

47. The system of claim 39, wherein the n=1 target comprises a metal layer and at least one positive ion source layer comprising hydrogen, boron, carbon, nitrogen, oxygen, an isotope of hydrogen, an isotope of boron, an isotope of carbon, an isotope of nitrogen, an isotope of oxygen, or any combination thereof, the metal layer side of the target being oriented towards the laser pulse source.

48. A system for generating positive ions, comprising:

at least one laser pulse source;

a series of n−1 beam splitters capable of splitting a laser pulse emanating from the laser pulse source into n laser pulses, wherein n is greater than 1;

a series of n targets capable of interacting with a laser pulse and generating an electric field in each of the n−1 targets;

an optical path capable of directing a first n=1 laser pulse to a first n=1 target at a time $t_1$ to give rise to positive ions emanating from the first n=1 target, the positive ions being directed towards the additional n−1 targets, the positive ions emanating from the first n=1 target being capable of arriving at the n=2 target at a time $t_2$ later than $t_1$.

49. The system of claim 48, further comprising a series of n−1 optical delays capable of the delaying the n−1 laser pulses so as to arrive at their designated n−1 target at a time later than the arrival of the previous laser pulse at its previous target.

50. The system of claim 49, wherein the optical delays comprise a series of mirrors to increase the optical path of each of the other n−1 laser pulses, wherein the optical path of each laser pulse to its target is longer than the optical path of its earlier laser pulse.

51. The system of claim 48, wherein n is in the range of from 2 to about 50.

52. The system of claim 48, wherein n is in the range of from 2 to about 10.

53. The system of claim 52, wherein n is in the range of from 3 to 6.

54. The system of claim 53, wherein the system is capable of giving rise to an energy distribution of positive ions emanating from the n=3 target being characterized as having an energy distribution peak that is at least about 20% higher than the energy distribution peak of the positive ions emanating from the n=1 target.

55. The system of claim 48, wherein the system is capable of giving rise to an energy distribution of positive ions emanating from the n=2 target being at least about 10% higher than the energy distribution peak of the positive ions emanating from the n=1 target.

56. The system of claim 48, wherein at least one target comprises hydrogen, boron, carbon, nitrogen, oxygen, an isotope of hydrogen, an isotope of boron, an isotope of carbon, an isotope of nitrogen, an isotope of oxygen, or any combination thereof.

57. The system of claim 48, wherein the n=1 target comprises a metal layer and at least one positive ion source layer comprising hydrogen, boron, carbon, nitrogen, oxygen, an isotope of hydrogen, an isotope of boron, an isotope of carbon, an isotope of nitrogen, an isotope of oxygen, or any combination thereof, the metal layer side of the target being oriented towards the laser pulse source.

58. A system for generating positive ions, comprising:

n laser pulse sources each capable of generating a laser pulse, wherein n is greater than 1;

a series of n targets, each one being oriented in an individual optical path that is capable of interacting individually with each one of the individual n laser pulses, the first n=1 target capable of giving rise to positive ions upon interaction with the n=1 laser pulse, wherein the remaining n−1 targets are positionally situated to be capable of receiving the positive ions in series from a previous target, wherein each one of the targets is capable of interacting with a laser pulse to give rise to an electric field capable of accelerating the positive ions.

59. The system of claim 58, further comprising delay circuitry capable of delaying the generation of at least one of the n−1 laser pulses relative to the n=1 laser pulse.

60. The system of claim 58, further comprising at least one beam splitter capable of splitting at least one laser pulse into at least two laser pulses.

61. The system of claim 60, further comprising at least one optical delay situated to give rise to a delay in at least one laser pulse arriving at its target.

62. The system of claim 61, wherein the at least one optical delay is situated so that during operation, at least one of the laser pulses arrives at a target other than the first target at a time later than the arrival of the laser pulse at the first target.

63. The system of claim 60, wherein one or more of the optical delays comprises a series of mirrors that increases the length of the optical path between one of the n−1 beam splitters and its target.

64. The system of claim 58, wherein n is in the range of from 2 to about 50.

65. The system of claim 58, wherein n is in the range of from 2 to about 10.

66. The system of claim 65, wherein n is in the range of from 3 to 6.

67. The system of claim 58, wherein the laser pulse source is capable of providing a laser intensity, I, of greater than about $10^{21}$ W/cm$^2$.

68. The system of claim 58, wherein the laser pulse source is capable of providing a laser pulse duration in the range of from about 1 femtosecond to about 1000 femtoseconds.

69. The system of claim 58, wherein at least one target comprises hydrogen, boron, carbon, nitrogen, oxygen, an isotope of hydrogen, an isotope of boron, an isotope of carbon, an isotope of nitrogen, an isotope of oxygen, or any combination thereof.

70. The system of claim 58, wherein the n=1 target comprises a metal layer and at least one positive ion source layer comprising hydrogen, boron, carbon, nitrogen, oxygen, an isotope of hydrogen, an isotope of boron, an isotope of carbon, an isotope of nitrogen, an isotope of oxygen, or any combination thereof, the metal layer side of the target being oriented towards the laser pulse source.

* * * * *